United States Patent [19]

Frei

[11] Patent Number: 4,573,585

[45] Date of Patent: Mar. 4, 1986

[54] JEWELRY DISPLAY

[76] Inventor: Linae Frei, 1343 Church St., Northbrook, Ill. 60062

[21] Appl. No.: 677,554

[22] Filed: Dec. 3, 1984

[51] Int. Cl.[4] ..... A47F 5/08

[52] U.S. Cl. ..... 211/13; 211/87; D6/568

[58] Field of Search ..... 211/90, 87, 13, 59.1; 206/566; D6/553, 563, 568, 569; 312/224, 225, 226, 227

[56] References Cited

U.S. PATENT DOCUMENTS

| | | | |
|---|---|---|---|
| D. 47,123 | 3/1915 | Stroke | D6/569 |
| D. 156,950 | 1/1950 | Formhals | 211/59.1 X |
| D. 219,878 | 2/1971 | Rowland | D6/563 |
| 489,593 | 1/1893 | Ramer | 211/59.1 X |
| 3,718,260 | 2/1973 | Sharp | 211/13 |
| 4,264,013 | 4/1981 | Vollmer | 211/13 |

*Primary Examiner*—Jr. Gibson

*Attorney, Agent, or Firm*—Gary, Juettner & Pyle

[57] ABSTRACT

A display is provided for the orderly, efficient and attractive retention and display of jewelry, comprising a planar member; a hanger for mounting the planar member to a vertical surface; one or more shelf members mounted to the front side of the planar member, each of the shelf members having one or more varieties of jewelry holders for holding rings, earrings and the like; a plurality of spaced apart hooks attached to the front surface of the planar member for retaining chains, necklaces and bracelets; padding covering at least a portion of the front surface of the planar member for retaining pins and broaches; and a mirror attached to the front surface of the planar member.

5 Claims, 3 Drawing Figures

JEWELRY DISPLAY

BACKGROUND OF THE INVENTION

The present invention relates to jewelry displays and the like, and especially devices for retaining and displaying jewelry and other paraphernalia in a noncommercial setting.

Personal jewelry is often kept in jewelry boxes, which in turn are kept on a dresser or bureau. The major drawback of the jewelry box is that it stores, but does not display its contents—requiring one to root through or empty the box to select the desired pieces. Jewelry boxes often do not contain mirrors of sufficient size to adequately reflect the selected pieces as worn. And finally, jewelry boxes generally add little to the decor of one's dressing room.

Various devices and articles of manufacture have been developed to overcome the disadvantages of the jewelry box, in commercial as well as domestic settings, for example U.S. Pat. No. 658,488 to Levy et al, U.S. Pat. No. 1,063,662 to Dahl and U.S. Pat. No. 3,718,260 to Sharp. Each of the foregoing, however, suffer the same general drawback, i.e., limited utility. The devices disclosed by Levy and Dahl are suitable for retaining and displaying rings, but no other types of jewelry. Sharp's device retains and displays rings, necklaces, bracelets, belts and some types of earrings, but is suitable only for jewelry having a ring or loop from which the piece may be hung from a peg. Many pieces of jewelry do not incorporate such rings or loops, for example, pins, broaches and certain types of earrings, and thus may not be carried on Sharp's device.

It would therefore be desirable to have a jewelry display that holds and displays all types of jewelry in an attractive manner.

OBJECT OF THE INVENTION

It is an object of the invention to provide a jewelry display that is functional as well as attractive. The primary functional object is to retain and display all types of jewelry namely, rings, earrings, bracelets, necklaces, broaches, pins, etc.

It is a further object of the invention to incorporate a mirror with the jewelry retaining and displaying elements.

It is yet a further object of the invention to provide a jewelry display that incorporates the functional aspects into an attractive display that provides a valuable decorative addition to one's dressing room.

SUMMARY OF THE INVENTION

The jewelry display of the invention comprises a planar member having a front surface, a hanger for mounting the planar member on a vertical supporting surface, shelf defining means attached to and extending outwardly from the planar member, jewelry retaining means attached to the shelf defining means for retaining rings and earrings, and a plurality of spaced apart hooks attached to and extending outwardly from the planar member for retaining bracelets, chains and necklaces. The display may also include a mirror attached to the front surface of the planar member and padding attached to and covering at least a portion of the front surface of the planar member for retaining pins and broaches.

The jewelry retaining means may be of one or more varieties. One variety comprises a plurality of spaced apart vertical pegs attached to the upper surface of the shelf defining means for retaining rings. A second variety comprises a plurality of adjacent pillows attached to the upper surface of the shelf defining means, the pillows defining slots therebetween for receiving rings or earrings. A third variety comprises a plurality of spaced apart hooks secured to the underside of the shelf defining means for retaining chains, bracelets and necklaces. The shelf defining means is at least one shelf member. One or more of the foregoing varieties of jewelry retaining means may be combined with each shelf member.

Thus, the foregoing display retains and displays all types of jewelry. The novel shelf members, having one or more varieties of jewelry retaining means, provide for the retention and display of all types of jewelry, regardless of the configuration of each piece of jewelry. The padding secured to the front surface of the planar member provides for the retention and display of pins and broaches as the pin component may be inserted into the padding. Also in accordance with the invention, a mirror is provided. The foregoing elements may be selected and arranged in a decorative display that is an attractive addition to one's dressing room, as more fully described below.

Other objects, advantages and features of the invention will become apparent from the following detailed description taken in conjunction with the accompanying drawings.

DETAILED DESCRIPTION

Figure 1:
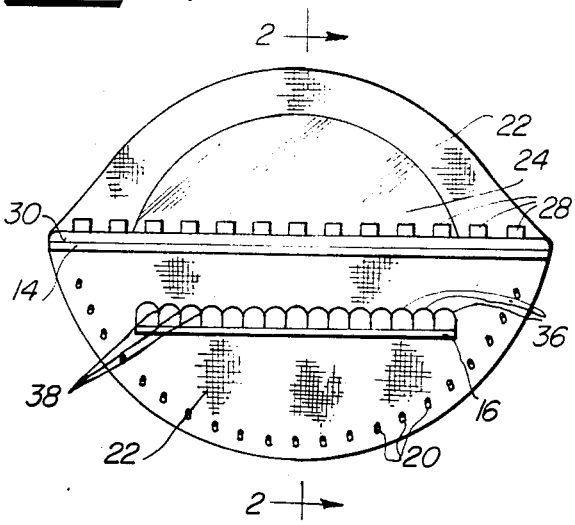
FIG. 1 is a full frontal view of one embodiment of the invention.
Figure 2:
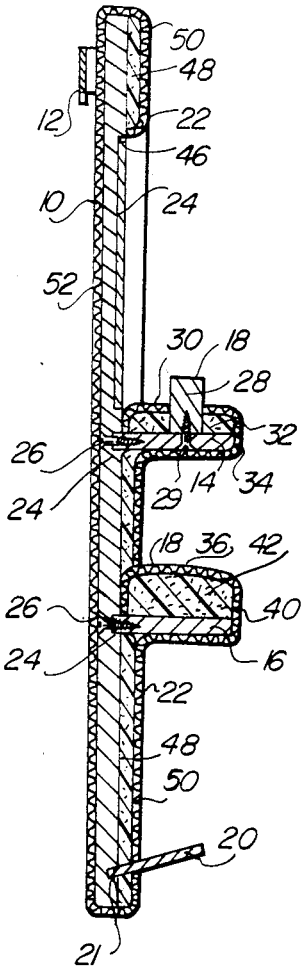
FIG. 2 is a vertical cross-section taken along line 2—2 of FIG. 1.

Referring to FIGS. 1 & 2, the first embodiment of the invention comprises a planar member 10, a hanger 12, a first shelf member 14, a second shelf member 16, means for retaining jewelry 18, a plurality of spaced apart hooks 20, padding 22 and a mirror 24.

The planar member 10 is preferably fabricated from wood, but may also be made from plywood, composite board, plastic, sheet metal or any rigid planar material. The planar member 10 may be cut to any desired shape.

The hangar 12 is preferably a commercially available metal, saw tooth type hangar, which is screwed or tacked to the back surface of the planar member 10. Thereby, the planar member 10 may be removably hung from a nail (not shown) driven into a vertical surface such as a wall or door (not shown). Other types of hangers such as a wire picture hanger could be used in lieu of a saw tooth hanger, but is not preferred as it is desirable that the planar member 10 be mounted in an as nearly vertical position as possible. Other means for mounting the planar member 10 to a vertical surface, such as a suspending ring, nails, screws, wall anchors and the like are possible alternatives to the illustrated hanger 12.

Shelf defining means comprises at least one shelf member 14. The first shelf member 14 may be fabricated from wood, plastic, metal or other rigid material. The shelf member 14 is preferably attached to the planar member 10 by inserting the shelf member 14 into a notch 24 cut into the front surface of the planar member 10 and securing the same by one or more screws 26. Other means known in the art for securing the shelf 14 to the planar member 10 may be used with equal facility.

A second shelf member 16 may be fabricated and secured to the planar member 10 in similar fashion as shelf member 14. The second shelf member 16 is optional, see FIG. 3 for example. Three or more shelf members could be incorporated if desired.

The means 18 for retaining jewelry may be of several varieties. One variety comprises a plurality of spaced apart vertical pegs 28 secured to the upper surface of the shelf member 14. The pegs 28 are preferably fabricated from wood, but may be plastic or metal. The pegs 28 may be secured to shelf member 14 by driving a tack or screw 29 through the underside of the shelf member 14 into the peg 28. Alternatively, the shelf member 14 may be drilled with a plurality of spaced apart holes having a diameter the same as the pegs 28. The pegs 28 may then be inserted and glued into the respective holes. In the preferred embodiment, padding 30 is secured to the shelf member 14 around the lower portion of the pegs 28 to protect rings that may be placed over the pegs 28. The padding 30 may be constructed by placing quilt batting or foam rubber 32 over the shelf member 14, covering the quilt batting or foam rubber 32 with fabric 34 and stapling or gluing the fabric 34 around its marginal edges to the shelf member 14.

A second variety of jewelry retaining means 18, comprises a plurality of adjacent pillows 36. The pillows 36 define jewelry retaining slots 38 therebetween for receiving rings or earrings. The pillows 36 may be constructed by wrapping fabric 40 around a bundle of quilt batting or foam rubber 42 and then stapling or gluing the edges of the fabric 40 to the shelf member 14 or 16.

Figure 3:
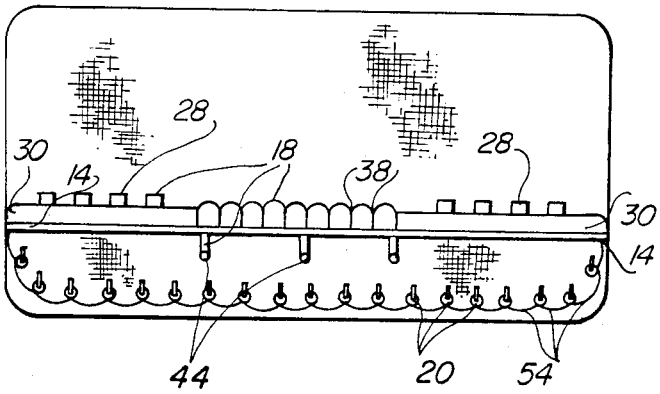
FIG. 3 is a full frontal view of a second embodiment of the invention.

A third type of jewelry retaining means 18 comprises a plurality of hooks 44 secured to the underside of the shelf member 14, see FIG. 3. The hooks 44 may be commercially available metal hooks that are screwed into the underside of the shelf member 14. Where two shelf members are employed, it is desirable that the hooks 44 be secured to the lower shelf member, to permit chains and the like to hang from the hooks 44 in an unobstructed manner.

One or more of the foregoing varieties of jewelry retaining means 18, as well as others known in the art, may be secured to the shelf member(s) 14 and 16 in various combinations, two examples of which are illustrated in FIGS. 1 and 3.

Hooks or horizontal pegs 20 are secured to the front surface of planar member 10, and may be constructed in various ways. FIGS. 1 and 2 illustrate horizonal pegs or hooks 20 comprised of dowels pressed and glued into corresponding holes 21 drilled in the front surface of the planar member 10. The dowels may also be secured to the planar member 10 by tacking and/or gluing the same, without need to drill holes. Where dowels are used, it is preferable that they are inclined slightly upwards towards the vertical to prevent chains and the like from slipping off. Alternatively, as illustrated in FIG. 3, the hooks 20 may comprise commercially available metal hooks, that may be screwed into the planar member 10. Inasmuch as the plurality of spaced apart hooks 20 are adapted to retain and display chains, bracelets, necklaces and the like, it is preferable that the same be located on the planar member 10 below the shelf members 14 and 16.

In the preferred embodiment, the invention further comprises a mirror 24 attached to the front surface of the planar member 10. The mirror 24 is preferably attached to planar member with an adhesive. To improve the appearance of the display, the mirror 24 may be fitted into a recessed area 46 in the planar member 10.

Also in the preferred embodiment, the display may further comprise padding 22 covering at least a portion of the front surface of the planar member 10. The padding 22 preferably comprises either quilt batting or foam rubber 48 covered by fabric 50. The padding 22 is constructed by placing the quilt batting or foam rubber 48 on to the planar member 10, covering the same with precut fabric 50 and securing the fabric 50 with staples or the like, around the fabric's marginal edges, to the planar member 10. The portion of the fabric 50 adjacent to the edges of the planar member 10, may be stretched over the edges of the planar member 10 and stapled to the back side of the planar member 10. The fabric 50 may be any type of natural or synthetic fabric or may be leather. In the preferred embodiment the padding 22 covers the entire front surface of the planar member 10, save for the areas occupied by the mirror 24, shelf members 14 and 16 and hooks 20.

The back of the planar member 10 may be covered with backing material 52, such as fabric, leather, felt and other like material, if desired. The jewelry board of the invention may be decorated with braids 54 or other like decorations as desired. Exposed wood, plastic or metal surfaces on the planar member 10, shelf members 14 and 16, pegs 28 and hooks 20 may be painted or covered with fabric or leather, if desired.

Virtually unlimited configurations of the novel display disclosed herein may be constructed in accordance with the invention. The planar member 10 may be cut to any desired shape, two such shapes being illustrated in FIGS. 1 and 3. Any number of shelf members 14 and 16 with various lengths and widths may be employed. Each shelf member 14 and 16 may employ one variety of jewelry retaining means 18, as illustrated in FIG. 1, or may employ a combination of jewelry retaining means 18, as shown in FIG. 3. A mirror 24 may be included, as in FIG. 1, or omitted, as in FIG. 3. Thus, by arranging the various elements and by the selection of different fabrics, the jewelry display of the invention may provide a unique and attractive display complementary to any decor.

While two embodiments of this invention and a representative mode of use thereof have been illustrated and described herein, it is to be appreciated that changes, modifications and variations may be made therein without departing from the scope of the invention as defined by the appended claims.

What is claimed is:

1. A jewelry display comprising:

a planar member having front and rear surfaces;

means on said rear surface for mounting said planar member to a vertical supporting surface;

shelf defining means attached to the front surface of said planar member, said shelf defining means having a plurality of spaced apart pegs attached to and extending upwardly from the upper surface thereof and a plurality of adjacent pillows attached to the upper surface thereof and defining jewelry receiving slots therebetween;

a plurality of spaced apart hooks attached to and extending outwardly from the front surface of said planar member; and padding attached to and covering substantially the entire front surface of said planar member.

2. A jewelry display as in claim 1, further comprising a mirror attached to the front surface of said planar member.

3. A jewelry display as in claim 1, further comprising padding attached to the upper surface of said shelf defining means adjacent to and surrounding the lower portion of said pegs.

4. A jewelry display as in claim 1, further comprising a plurality of spaced apart hooks attached to said shelf defining means.

5. A jewelry display comprising:

a planar member having front and rear surfaces;

means on said rear surface for mounting said planar member to a vertical supporting surface;

a mirror attached to the front surface of said planar member;

a first shelf member attached to the front surface of said planar member, said first shelf member having padding attached to its upper surface and having a plurality of spaced apart pegs attached to and extending upwardly from said first shelf member through and beyond said padding;

a second shelf member attached to the front surface of said planar member having a plurality of adjacent pillows attached to the upper surface of said second shelf member, defining jewelry receiving slots therebetween;

a plurality of spaced apart hooks attached to and extending outwardly from the front surface of said planar member; and padding attached to said planar member and covering substantially the entire front surface of said planar member.

* * * * *